US008905872B2

(12) United States Patent
Ennis

(10) Patent No.: US 8,905,872 B2
(45) Date of Patent: Dec. 9, 2014

(54) SPORTING GOAL TRANSPORT SYSTEM

(76) Inventor: Nelson Ennis, Wisconsin Dells, WI (US)

( * ) Notice: Subject to any disclaimer, the term of this patent is extended or adjusted under 35 U.S.C. 154(b) by 194 days.

(21) Appl. No.: 13/435,263

(22) Filed: Mar. 30, 2012

(65) Prior Publication Data

US 2012/0252606 A1 Oct. 4, 2012

Related U.S. Application Data

(60) Provisional application No. 61/470,165, filed on Mar. 31, 2011.

(51) Int. Cl.

| | |
|---|---|
| ***A63B 63/00*** | (2006.01) |
| ***A63B 63/04*** | (2006.01) |
| ***A63B 71/00*** | (2006.01) |
| *A63B 71/02* | (2006.01) |
| *A63B 71/06* | (2006.01) |
| *A63B 55/08* | (2006.01) |

(52) U.S. Cl.

CPC ..... *A63B 71/0036* (2013.01); *A63B 2220/12* (2013.01); *A63B 2071/025* (2013.01); *A63B 63/004* (2013.01); *A63B 2071/0683* (2013.01); *A63B 2055/086* (2013.01)

USPC ..... 473/478; 273/400; 273/406

(58) Field of Classification Search

USPC ..... 273/398–402, 359, 366–370, 406; 473/476–478, 483

See application file for complete search history.

(56) References Cited

U.S. PATENT DOCUMENTS

| | | | | |
|---|---|---|---|---|
| 4,346,893 | A | 8/1982 | Landsinger et al. | |
| 4,699,386 | A | 10/1987 | Carzino | |
| 5,035,423 | A * | 7/1991 | Arciniega | 473/433 |
| 5,080,375 | A * | 1/1992 | Moosavi | 473/478 |
| 5,273,292 | A * | 12/1993 | Pardi et al. | 273/400 |
| 5,556,106 | A | 9/1996 | Jurcisin | |
| 6,736,739 | B1 | 5/2004 | Epworth | |
| 6,761,644 | B1 * | 7/2004 | Aubert | 473/197 |
| 6,796,914 | B2 | 9/2004 | Berdugo et al. | |
| 6,881,163 | B2 * | 4/2005 | Schroeder et al. | 473/481 |
| 7,125,351 | B1 | 10/2006 | Raber | |
| 7,156,760 | B2 | 1/2007 | Berdugo et al. | |
| 7,611,148 | B2 | 11/2009 | Caswell | |
| 7,686,712 | B2 | 3/2010 | Sifrit | |
| 7,731,610 | B2 | 6/2010 | Im | |
| 7,775,916 | B1 | 8/2010 | Mahoney | |
| 7,828,678 | B1 | 11/2010 | Caruso | |
| 7,832,733 | B2 * | 11/2010 | Epstein et al. | 273/317.3 |
| 7,850,576 | B2 | 12/2010 | Sellke | |
| 7,984,910 | B1 * | 7/2011 | Nielsen | 273/359 |
| 2003/0108852 | A1 | 6/2003 | Berdugo et al. | |
| 2005/0020390 | A1 | 1/2005 | Berdugo et al. | |
| 2007/0176369 | A1 * | 8/2007 | Sellke | 273/407 |
| 2008/0132361 | A1 * | 6/2008 | Barber | 473/439 |
| 2009/0152419 | A1 | 6/2009 | Wallace | |

(Continued)

FOREIGN PATENT DOCUMENTS

| | | |
|---|---|---|
| EP | 0336 242 B1 | 9/1992 |

*Primary Examiner* — Mark Graham

(74) *Attorney, Agent, or Firm* — Boyle Fredrickson, S.C.

(57) ABSTRACT

A sport goal movement system that includes drive and control systems. The drive system preferably includes a motor that selectively drives one of a wheel or a track. The drive system can be integrated with and/or permanently or removably secured to the sport goal assembly. Operation of the drive system effectuates single user unassisted and possibly remote translation of the sport goal assembly relative to a ground surface.

14 Claims, 5 Drawing Sheets

(56) References Cited

U.S. PATENT DOCUMENTS

| | | | | |
|---|---|---|---|---|
| 2009/0163304 | A9 | 6/2009 | Caswell | |
| 2009/0197709 | A1 | 8/2009 | Rogers | |
| 2010/0029416 | A1 * | 2/2010 | Lindstrom | 473/477 |
| 2010/0062880 | A1 * | 3/2010 | Hayes | 473/422 |
| 2010/0184538 | A1 | 7/2010 | Reeves | |
| 2010/0304902 | A1 | 12/2010 | Holland et al. | |
| 2010/0317467 | A1 | 12/2010 | Freynhofer et al. | |
| 2011/0140363 | A1 * | 6/2011 | Gravel | 273/406 |

* cited by examiner 82, 84
66, 68
100
102
90
96
98
94
92

82, 84
102
66, 64
90
104
94
98
106
92

86
80
72
114
70
66
98
82
54
52
62
48
14, 16
60
12
88
46
114
40
74
84
68
58
64
50

SPORTING GOAL TRANSPORT SYSTEM

CROSS-REFERENCE TO RELATED APPLICATIONS

This application claims priority to U.S. Provisional Patent Application Ser. No. 61/470,165 filed on Mar. 31, 2011, titled "Remotely Controllable Soccer Goal", and the disclosure of which is expressly incorporated herein.

BACKGROUND OF THE INVENTION

The present invention relates generally to field sports and, more particularly, to the ancillary structures, such as goals, which are commonly associated with a playing field or pitch and shaped and positioned with consideration to the objectives and/or scoring of a particular game. Understandably, there are a number of reasons that can arise wherein it is desired to move one or more respective game goal structures from one position to another. Such reasons can include positioning a goal at a location relative to a playing field, lines associated with the playing field, and/or manipulating the orientation of one goal relative to another goal. Such goal structures are also commonly periodically moved from either in-use or stored positions for use during practice drills, to play games with alternate objectives, to allow servicing of the playing surface, so that the playing surface can be used for purposes other than those associated with the goal, and/or for servicing of the goal structure.

Soccer is perhaps the most popular sport in the world. In some instances, soccer goals are fixed, but such goals are also commonly portable when anchoring systems are removed for moving the particular goal structure. Regardless of the particular use of a sporting field, it is common that such goal structures must be periodically moved from their respective in-use positions relative to the field to any of stored positions, service positions, out of the way locations, drill positions, and virtually any location that is not the common or standard position of the goal as defined by a gaming event. It is also commonly efficient or expedient for grounds personnel to physically move the goal structures to attend to field maintenance and/or preparation and near immediate subsequent return of the goal to the in-use position.

Regardless of the particular event and the size and shape of the goal structure associated with the particular sporting event, many upright sport goal structures are commonly constructed of relatively heavy materials and/or awkwardly shaped such that a single individual is commonly unable translate the goal structure without undue effort and/or undue risk of damage to a playing surface. Fortunately, many games associated with such goal structures are commonly played with a large number of players. To reduce damage to the play surface, a number of players can be gathered and whose collective cooperation can lift and move the game goal structure without damaging the goal structure and/or the play surface. Unfortunately, coaches, staff, and/or facility managers also periodically desire to move such goal structures during non-event times when too few capable persons are available for comfortable or non-strenuous movement of such goal structures. Goal movement can be particularly arduous, tiresome, and time consuming for the users, staff and employees of those facilities that have a large number of commonly substantially spaced playing fields and the respective goal structures. That is, manually moving each goal structure for different uses of the space or the goal structures can be tiresome as well as time consuming for those involved in such activity.

Others have attempted to better facilitate the mobility of such field sport goal systems by various means. One such means includes manipulating the conventional structure of the goal frame and/or netting such that the resultant goal structure is smaller and thereby lighter than other conventional and regulation size goal structures. Understandably, such modifications are unacceptable for regulation play when such manipulation alters the size and/or shape of the goalmouth from the regulation requirements.

Still others offer modified conventional steel, aluminum, and/or plastic type goal frame structures wherein the goal frame and/or netting materials are formed of lighter weight materials and/or formed of materials that have reduced cross-sectional diameter and/or material thicknesses. Unfortunately, such modifications present additional drawbacks. Such light weight goal structures are more susceptible to tipping during improper use as well as proper use, susceptible to movement due to incidental contact during game play, susceptible to possible structural failure and/or deformation of the frame shape, and/or more readily susceptible to undesired movement by ill intentioned third parties. Accordingly, reducing the shape of the goal structure from a preferred size and shape and/or reducing the structural integrity of the goal frame assembly has met only very limited market acceptance and such goal assemblies still commonly require more than one person to effectuate non-damaging movement of the goal structure relative to a play surface.

Accordingly, there is a need for a system and method that allows the convenient transport of a sporting goal by fewer users than could conveniently lift the goal structure and does so in a manner that does not mar or otherwise damage or alter the playing surface. There is a further need for a selectively operable goal structure movement device that allows automatic or unattended operation of the movement system after being provided with a desired instruction from a user or technician. There is further a need for a goal frame movement system that can be conveniently associated with more than one goal structure so that multiple goal frames can be moved with a single goal movement system.

SUMMARY OF THE INVENTION

The present invention provides a sporting goal transport system and method that resolves one or more of the aforementioned drawbacks. The sport goal movement system includes a drive system and a control system. The drive system preferably includes a motor that selectively drives one of a wheel or a track. The drive system can be integrated with and/or permanently or removably secured to the generally rigid structure of the sport goal assembly. Operation of the drive system effectuates unassisted single user and preferably remote translation of the sport goal assembly relative to a ground surface.

Another aspect of invention that is useable with one or more of the above aspects discloses a sport goal assembly having a frame that is shaped to define a goalmouth and support a goal net for interaction with one or more players on a playing field. At least one frame propulsion device is engaged with the frame and operative to translate the frame along a surface. At least one motor selectively drives the at least one frame propulsion device to effectuate translation of the goal frame relative to the play surface.

Another aspect of the invention that is usable or combinable with one or more of the above aspects discloses a goal transport system having a frame that removably engages with a field sport goal. The system includes a drive member that is supported by the frame and a motor that is connected to the drive member and the frame such that operation of the motor effectuates movement of the drive member relative to a ground surface and movement of the field sport goal when the field sport goal is engaged with the frame.

Another aspect of the invention that is usable or combinable with one or more of the above aspects discloses a method of providing a sport goal movement system. The method includes connecting a drive system to a power supply and engaging the drive system with a goal structure so that operation of the drive system effectuates single user un-assisted or non-manual human physical translation of the goal structure relative to a play surface.

In a preferred aspect, the goal frame transport system associated with the sport goal frame structure includes a first and a second drive system that are each associated with a respective end of the longitudinal shape of the goal structure. Preferably, one or more non-driven wheel assemblies can also be engaged with the goal frame structure such that the goal frame assembly is supported by the spaced association of the drive systems and the non-driven wheel assemblies.

In a more preferred aspect, each drive system associated with a respective goal frame structure is operatively associated with a wireless communication system that allows a user to wirelessly control the operation of the one or more drive systems. In a preferred embodiment, the wireless communication system includes a remote control that allows a user to instantaneously control one or more drive systems. More preferably, the control system is configured to communicate a destination instruction to one or more goal frame structures such that the goal frame structures are transported to the destination locations without further interaction or instruction from the user.

These and various other aspects and features of the present invention will be better appreciated and understood when considered in conjunction with the following detailed description and the accompanying drawings. It should be understood that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

The drawings illustrate one preferred embodiment presently contemplated for carrying out the invention. In the drawings.

Figure 1:
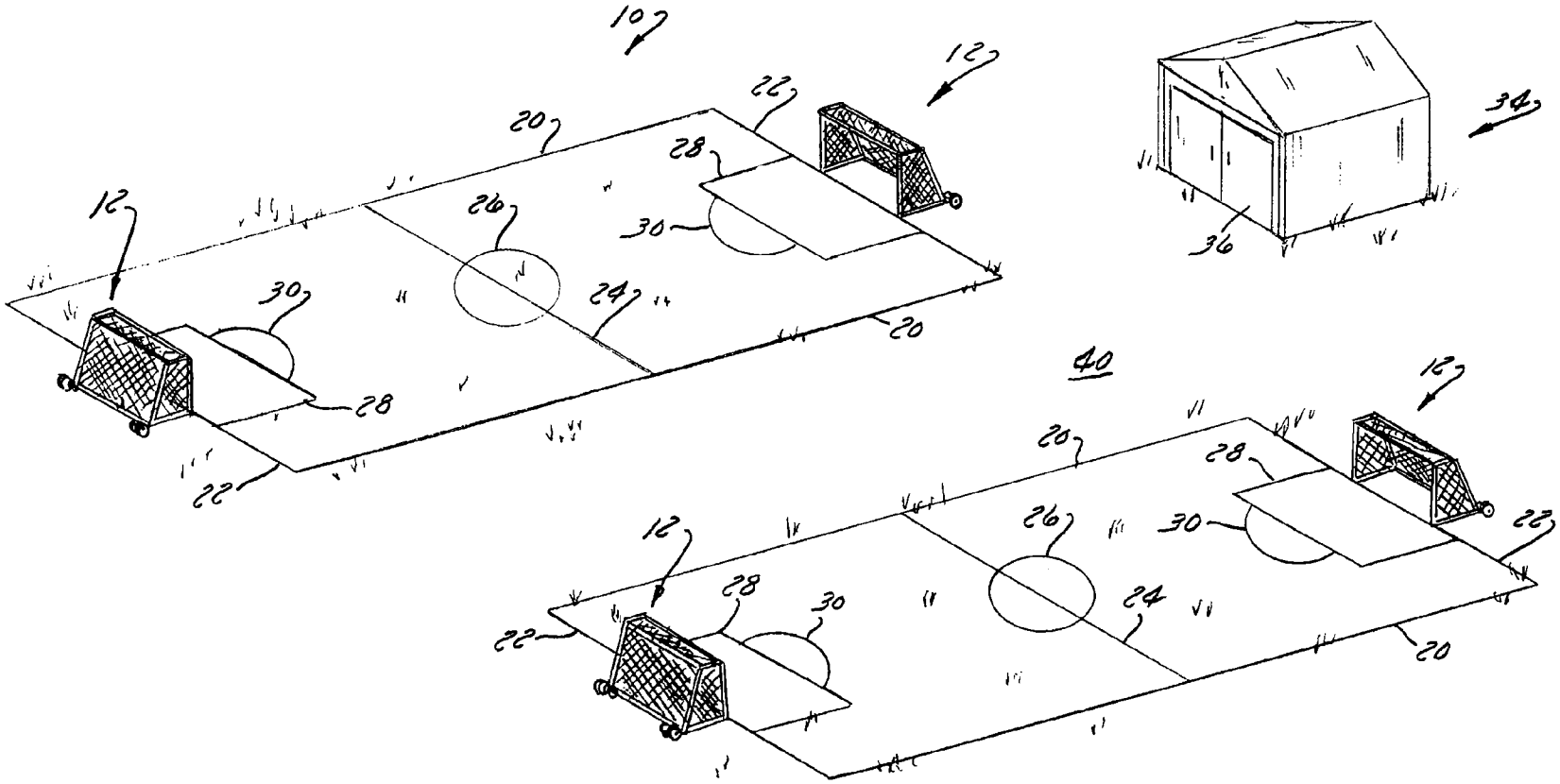
FIG. 1 is a perspective view of a sporting facility having several goal assemblies and covered storage wherein one or more of the goal assemblies are equipped with goal transport systems according to the present invention.

In describing the preferred embodiments of the invention that are illustrated in the drawings, specific terminology will be resorted to for the sake of clarity. However, it is not intended that the invention be limited to the specific terms so selected and it is to be understood that each specific term includes all technical equivalents that operate in a similar manner to accomplish a similar purpose. For example, the word "connected," "attached," or terms similar thereto are often used. They are not limited to direct connection but include connection through other elements where such connection is recognized as being equivalent by those skilled in the art.

DETAILED DESCRIPTION OF THE PREFERRED EMBODIMENT

FIG. 1 shows a sport facility 10 having a number of sport goal assemblies 12 according to the present invention. Facility 10 includes a first field 14 and a second field 16 which can each accommodate distinct field games which are commonly associated with a number of players on alternate teams. Fields 14, 16 are shown as soccer or, as referred to internationally, football fields but it is appreciated that the present invention is useable with other types of facilities and/or field sport events which may require or periodically desire use of movable goal structures. That is, although fields 14, 16 are shown as respective adult regulation size soccer fields being approximately 100×70 yards, it is appreciated that the present invention will be useable with other sized playing fields, as may be based on the age group of the players, such as 80×50 for under 11 years, 60×40 yards for under 10 years, 45×30 for under 9 years, etc. wherein the dimensions are in yards and the years indicates the desired age group for the respective players. It is further appreciated that the present invention is applicable to other sport or game events having goal structures that are similar or different than the construction, size and shape of goal assemblies 12. That is, the shape of goal assemblies 12 as a soccer goal is exemplary of only one goal or game frame assembly useable with the present invention.

It is further appreciated that one or more of various field lines, such as lateral side boundary lines or touchlines 20, respective longitudinal end or goal lines 22, a halfway line 24, a center-circle 26, a penalty area 28 and/or a penalty arc 30, etc. can be scaled or otherwise alternated to accommodate the game to be played as well as different age groups of players, associated with any of a number of multiple player field sport games. As explained further below, it is further disclosed that, in addition to the position, the shape of one of more of goal assemblies 12 can be manipulated to satisfy the goal spatial requirements associated with any of a number of class of player. Such a construction further increases the utility of goal assemblies 12 as compared to rigid goal structures which are specifically configured and sized for use with commonly only one class or age group of users.

Facility 10 preferably includes a storage space or simply storage 34 that is shaped to cooperate with one and preferably all of the goal assemblies 12 associated with facility 10. Storage 34 is preferably sized to accommodate all of the ancillary materials and equipment associated with operation and management of facility 10. Preferably, storage 34 includes one or more doors 36 that allow users and/or personnel associated with facility to periodically move goal assemblies 12 from in-use orientations, such as the exemplary positions or orientations as shown in FIG. 1, to stored locations, such as being located internal to storage 34 wherein goal assemblies are securable and protected from atmosphere. It is further appreciated that other non-use or alternate game play orientations and positions of goal assemblies exist outside of storage 34 and are merely defined as positions other at the end lines or game play orientation of the respective goal assemblies and/or other locations wherein the respective goal assemblies are not positioned and/or oriented for use in a game, practice, or other use, game or preparation type activities.

Although FIG. 1 shows an exemplary outdoor facility, it is further appreciated that the present invention is applicable and/or useable with indoor facilities as well. It is further appreciated that when facility 10 is provided as an indoor facility, providing covered protection of goal assemblies 12, such as storage 34, could be considered unnecessary and the stored or non-use positions of goal assemblies 12 would merely refer to the positioning of goal assemblies 12 outside of a play or practice area so as to not interfere with a particular activity associated with other uses of the facility.

It is further appreciated that, although many indoor type facilities do not include conventional sod and/or grass play surfaces, regardless of the indoor or outdoor nature of facility 10, it is periodically desired to move one or more of goal assemblies 12 to care for or service play surface 40. Surface 40 may be a grass surface requiring periodic cutting and/or trimming, such as that shown in FIG. 1, or may include any number of synthetic play materials that generally require less extensive upkeep than conventional grass or organic surface or ground coverings. Regardless of the specific composition of play surface 40, goal assemblies 12 are constructed to allow the expedient and single-user translation of one or more of goal assemblies 12 regardless of the reason(s) behind the desire to move a respective goal assembly and to do so in a manner that does not comprise or otherwise detract from the integrity of the underlying ground or goal support surface.

Figures 2, 3, 4:
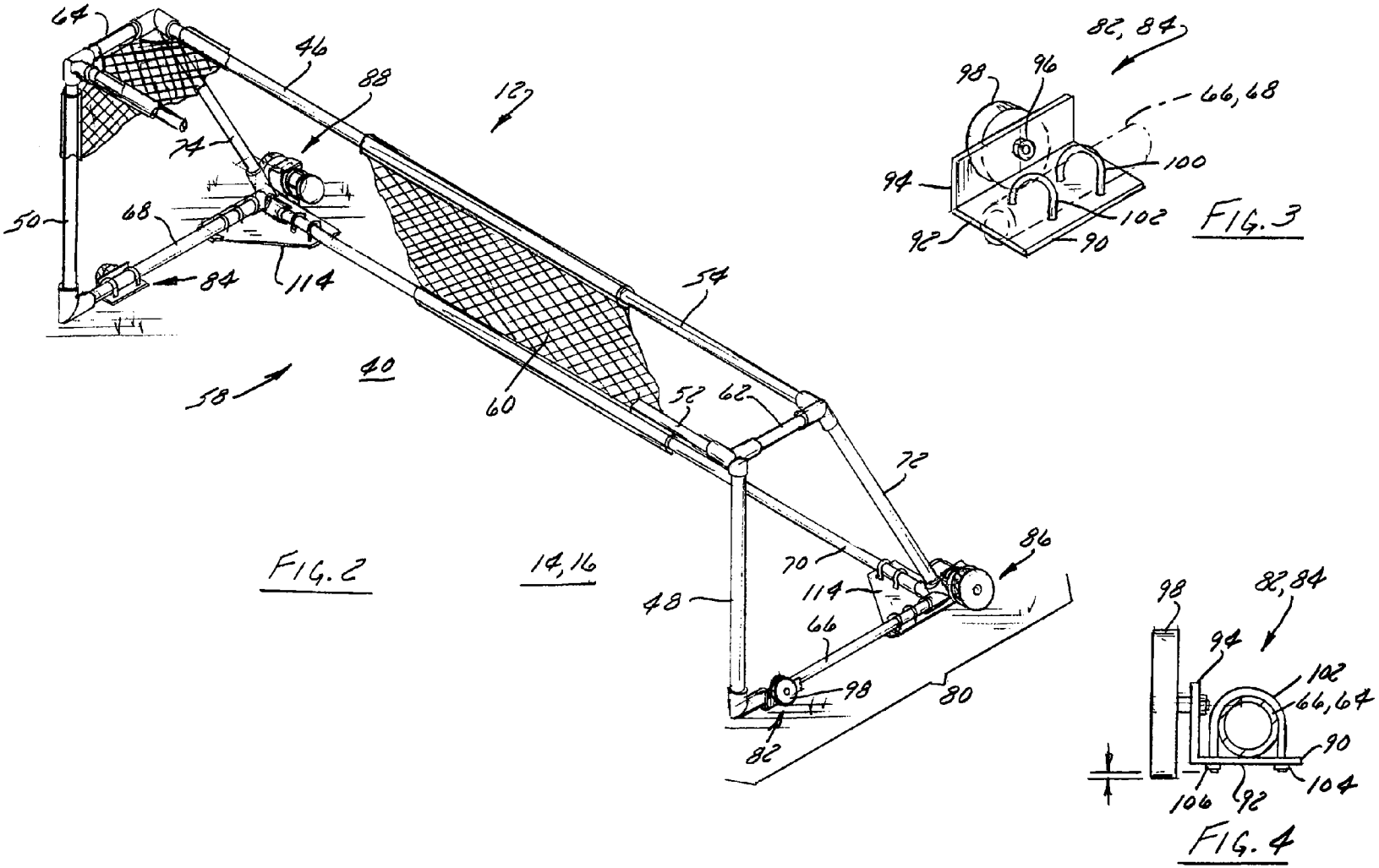
FIG. 2 is a perspective view of one of the movable goal assemblies shown in FIG. 1.
FIG. 3 is a perspective view of a non-driven transport assembly associated with the goal assembly shown in FIG. 2.
FIG. 4 is a side elevation view of the transport assembly shown in FIG. 3.

FIG. 2 is a detailed perspective view of one of goal assemblies 12 shown in FIG. 1. Goal assembly 12 includes a frame 46 having a pair of spaced apart upright goal posts 48, 50 connected by one or more horizontally extending crossbars 52, 54. Goal posts 48, 50 and crossbar 52 define a goalmouth 58 as the vertical plane that extends upward from goal line 22 and is bounded by goal posts 48, 50 and crossbar 52. Goalmouth 58 extends upward from the generally opposite longitudinal ends of the playing field ("pitch") associated with fields 14, 16. For adult and certain classes of youth play, goalmouth 18 is preferably eight yards or 24 feet wide by eight feet high to be compliant with rules set by the International Federation of Association Football ("FIFA"). FIFA also currently requires that goal posts 48, 50 be no greater than five inches in diameter. It is understood that goal assembly 12 is not limited to FIFA approved dimensions and thus may be sized differently, such as for use as a youth soccer goal, and/or be shaped for use with other sports as disclosed above.

Frame 46 can include additional frame members to support a goal net 60 recessed relative to goalmouth 58 to collect balls or other sporting accessories that may pass through goalmouth 58. In this regard, the frame 12 includes optional upper rails 62, 64 and lower rails 66, 68 that extend rearward from goalmouth 58 relative to field 14, 16 and from the upper and lower ends of upright goal posts 48, 50. The upper and lower rails 62, 64, 66, 68 connect to respective upper and lower ends of optional rear upright posts 72, 74. The lower ends of the upright posts 72, 74 are connected to rear lower crossbar 70 that sits atop surface 40 to provide stability for frame 46, such as to prevent tipping of the frame, and to provide rigidity for the mobility of frame 46.

In a preferred embodiment, the various longitudinal members of frame 46 are interconnected to form a single unitary inseparable frame structure. For example, the frame components could be welded together in a conventional manner but it is appreciated that the space frame shape of frame 46 could also be formed by the interconnection of various longitudinal members with temporary or other non-permanent connection methodologies.

In accordance with a preferred embodiment of the invention, goal assembly 12 is equipped with a drive system 80 that can be operated to selectively position and/or orient goal frame 46 relative to surface 40. In a preferred embodiment, drive system 80 includes four separate translation assemblies 82, 84, 86, 88 that are mounted or otherwise secured to frame 46. In a preferred embodiment, translation assemblies 82, 84 are un-driven whereas translation assemblies 86, 88 are each driven such that operation of the respective translation assembly 86, 88 imparts movement of frame 46 relative to surface 40. It is appreciated that, depending on the structure of the underlying goal assembly and the maneuvers desired to be performed, other numbers and orientations of driven and non-driven translation assemblies can be provided other than that which is shown.

Referring to FIGS. 2-4, each translation assembly 82, 84 includes a base 90 that includes a horizontal portion 92 and a vertical portion 94. An axle 96 cooperates with vertical portion 94 of base 90 and supports a propulsion device or wheel 98 relative thereto. Although shown as a wheel, it is further appreciated that one or more endless tracks could be provided rather than the wheels as shown. It is further appreciated that, although each wheel 98 is independently mounted to the corresponding base 90 via a respective fixed orientation axle 96, pivotable axle assemblies, such as those provided by caster-type wheels, and or a steerable axle can also be provided. Preferably, wheels 98 have a diameter of approximate 8½ inches and have a turf tread on the external radial face thereof. Alternatively, as explained further below, operation of the driven drive systems can be manipulated to effectuate steered translation of the respective goal assembly 12 relative to surface 40.

As shown in FIG. 4, one or more fasteners 100, 102 cooperate with horizontal portion 92 of base 90 and extend about an adjacent portion of a respective frame member 66, 68 of frame 46. A pair of nuts 104, 106 cooperate with the opposite longitudinal ends of each fastener 100, 102 such that the respective frame member 66, 68 can be snugly captured between fastener 100, 102 and horizontal portion 92 of base 90 which in turn also secures wheel 98 to frame 46. Preferably, each fastener 100, 102 has a 5 inch curved diameter, which correlates to a FIFA standards explained above, that snuggly but slideably cooperates with the respective rail or post of frame 46. Understandably, it is appreciated various means can be used to secure translation assemblies 82, 84 to frame 46.

As shown in FIG. 4, wheel 98 is preferably oriented relative to base 90 so as to extend a distance, indicated by arrow 110, beyond the lowermost structures associated with horizontal portion 92 of base 90, fasteners 102, and nuts 104, 106 of translation assembly 82, 84. Distance 110 is preferably selected to be about ½ inch so as to provide a minimum interference of base 90 and fasteners 100, 102 with the operation of wheel 98 during translation of frame 46 relative to surface 40. Understandably, other spacings are envisioned. It is further envisioned that one or more of translation assemblies 82, 84 could be movably or removably connected to frame 46 so that wheel 98 can be disengaged from surface 40 when a respective goal assembly attains a desired position.

It should further be understood from FIGS. 3 and 4 that translation assemblies 82, 84 include no drive means and therefore provide only static operation of wheels 98. As disclosed further below with respect to FIGS. 2 and 5-7, unlike translation assemblies 82, 84, translation assemblies 86, 88 are also secured or pivotably connected to frame 46 but are powered so as to provide controlled operation of the corresponding drive or propulsion device so as to allow a single user to translate goal frame 46 relative to surface 40.

Figure 5:
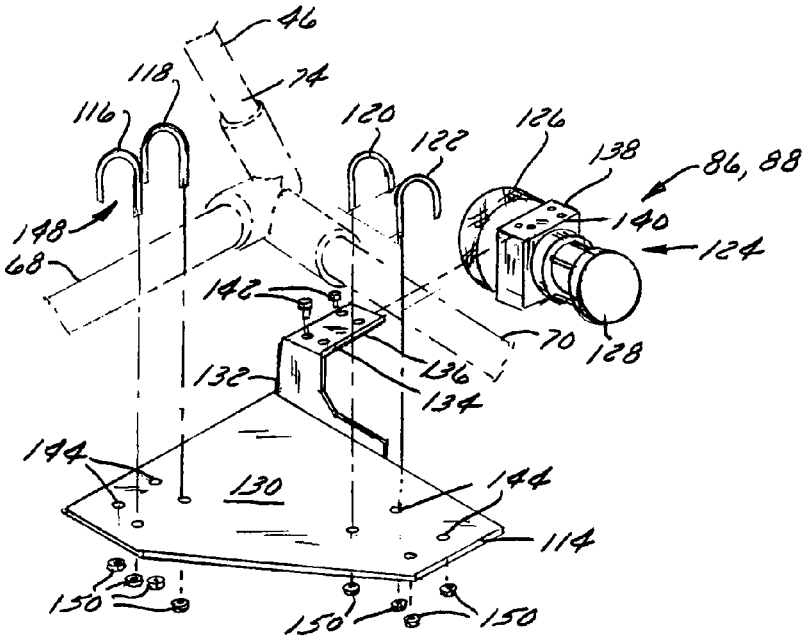
FIG. 5 is a partial exploded perspective view of a driven transport assembly associated with the goal assembly shown in FIG. 2.
Figure 6:
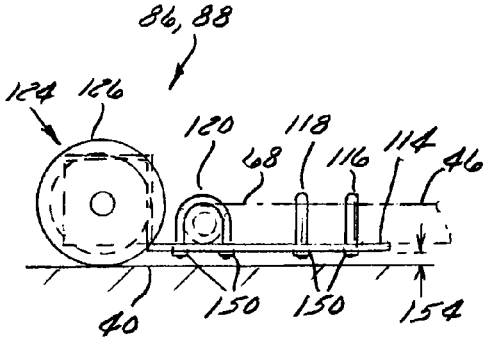
FIG. 6 is a side elevation view of the transport assembly shown in FIG. 5.
Figure 7:
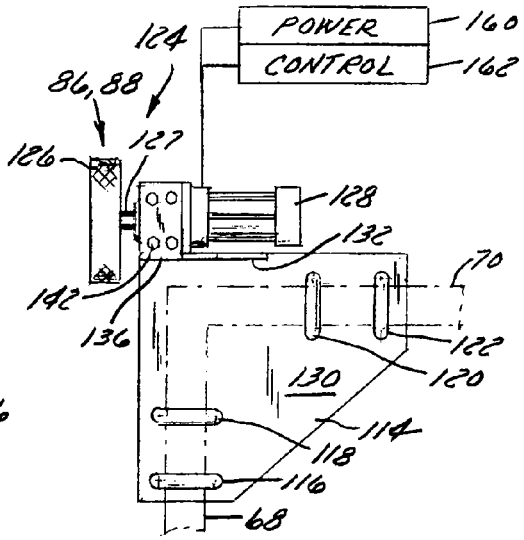
FIG. 7 is a top plan view of the transport assembly shown in FIG. 5.

Referring to FIGS. 5-7, each translation assembly 86, 88 includes a base 114, one or more fasteners 116, 118, 120, 122, and a drive mechanism 124 that includes a frame propulsion device or a drive member 126 and a motor 128 that is operatively connected to the respective drive member 126. Although drive member 126 is shown as what is commonly understood as a wheel, it should be further appreciated that drive member 126 can also be provided in other forms such as, for example, an endless track.

Although each translation assembly 86, 88 is shown as secured to an underlying goal assembly with generally rigid structures of fasteners 116, 118, 120, 122; other means of providing a secure interaction between goal assembly 12 and any of translation assemblies 82, 84, 86, 88. For instance, it is envisioned that translation assemblies 86, 88 could be configured to engage and disengage from different goal assemblies in a fairly automatic manner. That is, it is envision that frame 46 and/or assemblies 86, 88 could be equipped with a dog and pawl interaction or other selectively severable electrical, electromechanical, or mechanical interaction wherein the position and/or orientation of a respective translation assembly 86, 88 relative to a respective goal could effectuate an "auto" engage and/or disengage sequence from a respective goal assembly.

It is further appreciated that the generally rearward location of each of translation assemblies 86, 88 further improves the forward tip resistance of goal assembly 12 by at least further increasing the weight or counterweighing the rearward most end of goal assembly 12. It is further appreciated that one or more of translation assemblies 82, 84, 86, 88 include a ground engaging system wherein, when it is not desired to move a respective goal assembly 12, the ground engaging system interacts with surface 40 to provide a more stable and preferably untippable interaction of goal assembly 12 relative to surface 40. Understandably, such tip resistance structures can be included in one or more of translation assemblies 82, 84, 86, 88 and/or at other locations along those longitudinal members of goal assembly 12 that are adjacent surface 40. If provided with translation assembly 86, 88, it is further appreciated that the ground engaging systems may be integrated with, powered by, and/or operated in an automatic fashion via integration with the underlying power and or control systems of the respective translation assembly.

For a goal assembly 12 associated with two driven drive mechanisms 124, each wheel 126 is independently operable such that the speed at which each wheel 126 is driven can be used to effectively steer the frame 46 of goal assembly 12. For example, faster operation a right side drive mechanism relative to a left side drive mechanism enables directional rotational of the respective goal assembly to effectuate a turn toward the slower operating drive mechanism. Thus, differential rotational speed between the left-side wheel and the right-side wheel can be used to effectuate steering of the frame. Understandably, same speed operation of the left and right side drive mechanisms results in generally linear or straight line movement of the respective goal assembly.

Like base 90, base 114 includes a horizontal portion 130 and a vertical portion 132. A flange 134 extends in an outward direction from vertical portion 132 relative to horizontal portion 130 of base 114 and includes one or more perforations 136 formed therethrough. Drive mechanism 124 includes a mount body 138 that also includes a number of perforations 140. Fasteners, such as a number of bolts 142, pass through the openings 136 of flange 134 and operatively engage the passages 140 formed in mount body 138 and secure drive mechanism 124 relative to base 114.

Horizontal portion 130 of base 114 also includes a number of perforations or holes 144 that are shaped and oriented to slidably cooperate with the opposite longitudinal ends of the generally U-shaped fasteners 116, 118, 120, 122, respectively. Fasteners 116, 118, 120, 122 define a gap 148 that is shaped to slidably cooperate with one or more of the elongated members of frame 46 and are also preferably shaped to cooperate with the FIFA adult goal structure standards. The number of nuts 150 cooperate with the opposite ends of respective fasteners 116, 118, 120, 122 such that nuts 150 are engaged therewith so that the respective frame members 66, 68, 70 are rigidly secured relative to base 114. As shown in FIG. 6, when drive mechanism 124 is secured to frame assembly 46 wheel 126 maintains an offset distance or spacing 154 between frame 46 and surface 40. Preferably, space 154 is also approximately ½ inch when wheel 126 is engaged with space 154 but other spatial clearances, such as 1-2 inches are envisioned and feasible.

It is further appreciated that, although each of translation assemblies 82, 84, 86, 88 is shown as a structure that is independently securable to a frame 46 of goal assembly 12, and that such a configuration allows the conversion of existing goals into easily transportable goal assemblies, it is further envisioned that one or more of translation assemblies 82, 84, 86, 88 and/or the respective components thereof, such as wheels 98, 126, axles 96, 127, motor 128, a power source 160, and/or a control system 162 could be integrated into or combined with the structure of goal frame 46. Although such a configuration may limit the more than one goal applicability of the respective mobility system, such integration would limit redundant rigid frame and/or base structures. As shown, translation assemblies 82, 84, 86, 88 can be quickly and conveniently oriented relative to respective goal frames, execute a desired translation, and be subsequently associated with further goal structures for those applications wherein each goal structure of a particular facility does not include equal numbers of goal frames and mobility systems.

Figure 8:
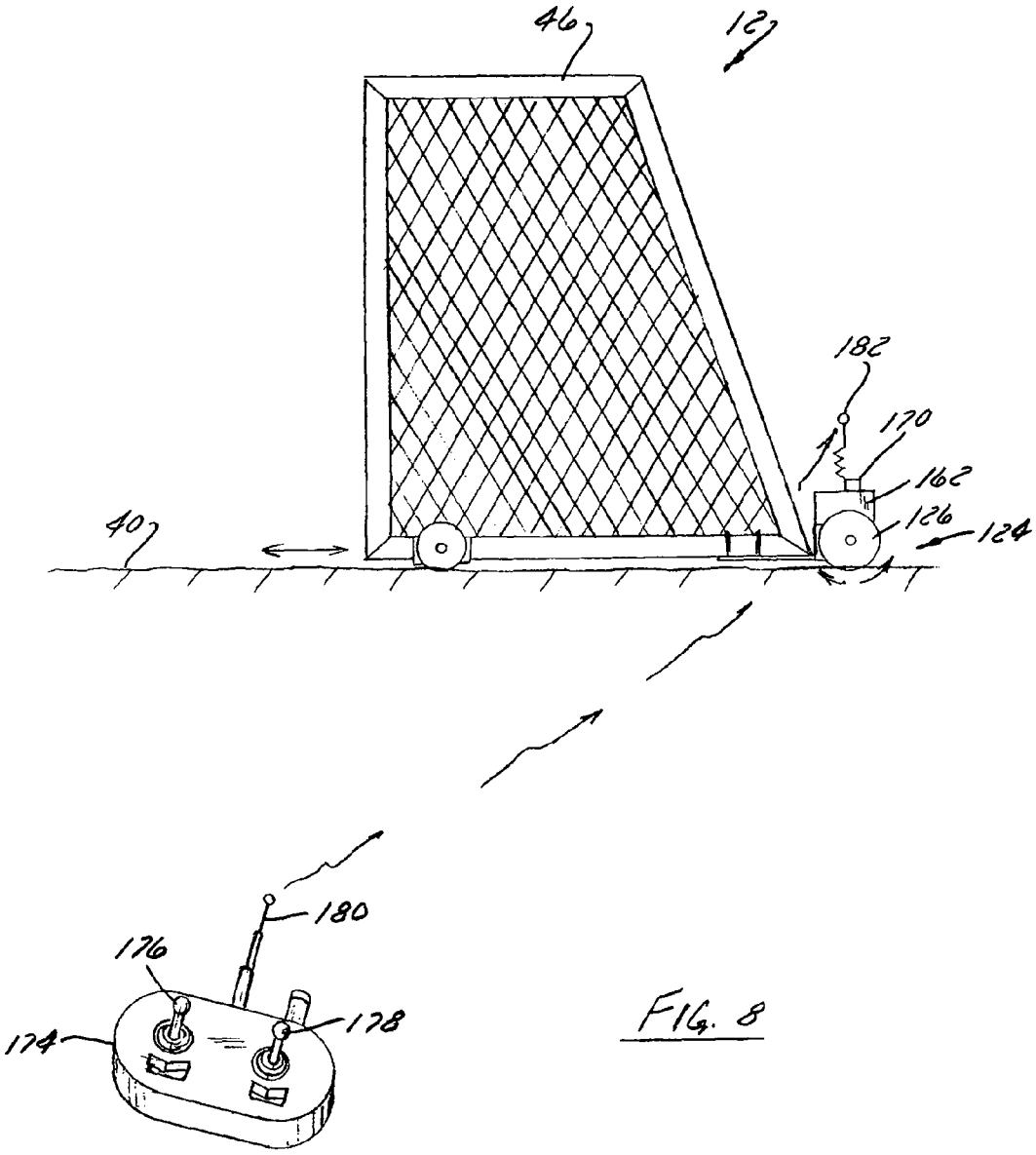
FIG. 8 is a side view of the goal assembly shown in FIG. 2 shown with a wireless controller of the transport assembly.

Referring to FIG. 7, drive system or mechanism 124 includes a power source 160 and a control system 162 that are operatively connected to motor 128. As explained further below with respect to FIGS. 8-10, the operation and control of drive system 124 allows single person remote manipulation of the position and orientation of goal assemblies 12 relative to surface 40. As alluded to above, it is appreciated that power source 160 and control system 162 can be supported by and/or integrated with, any of mount body 138, base 114, and/or frame assembly 46. It is further appreciated that should power source 160 and/or control system 162 be integrated into frame 46 of goal assembly 12, that an separable connection be provided between power system 160, control system 162, and motor 128 to allow use of drive mechanism 124 with other similarly equipped goal frames. Regardless of the specific orientation of the respective or collective power and control systems, control system 162 preferably includes at least one processor that is supported in a conventional manner on a circuit board and has one or more code(s) programmed thereupon, that, when executed, cause the processor to convert the signals received from the remote controller into command signals delivered to motors 128 to effectuate translation of the respective goal assembly 12.

Regardless of the relative orientation of each of power system 160 and control system 162, in a preferred embodiment of the invention as shown, each wheel 126 of a driven drive mechanism 124 has a motor 128 that drives rotation of a respective axle 127. Alternative, a single motor 128 can be configured to drive wheels at the opposite ends of a respective goal assembly. Motor 128 is preferably an electric motor that is powered by a high capacity rechargeable battery associated with power system 160. In a preferred embodiment, the batteries are rechargeable lithium-ion batteries. It is envisioned that the power supply or batteries could be charged by a utility power supply by mechanically connecting the batteries to a charging cable that feeds charging current from the utility power supply to the batteries and/or frame 12 include solar or photovoltaic cells that provide charging current to the batteries for those applications wherein soccer goal assembly 12 is used primarily outside and thus normally exposed to sunlight. Incorporating solar cells into goal assembly 12 allows this sun exposure to be exploited for recharging the batteries.

Although each driven drive mechanism 124 is shown as including a discrete motor and wheel pair, it is further appreciated that a single or shared motor could be used to drive more than one wheel. When configured for single wheel operation, each motor is preferably rated at 2 hp. It is appreciated that different types of arrangements could be used to connect the respective output shafts of the respective motors to the respective wheel(s). For example, a sprocket and chain arrangement could be used or the wheel could be connected directly to the rotational shape of the respective motor.

Figure 9:
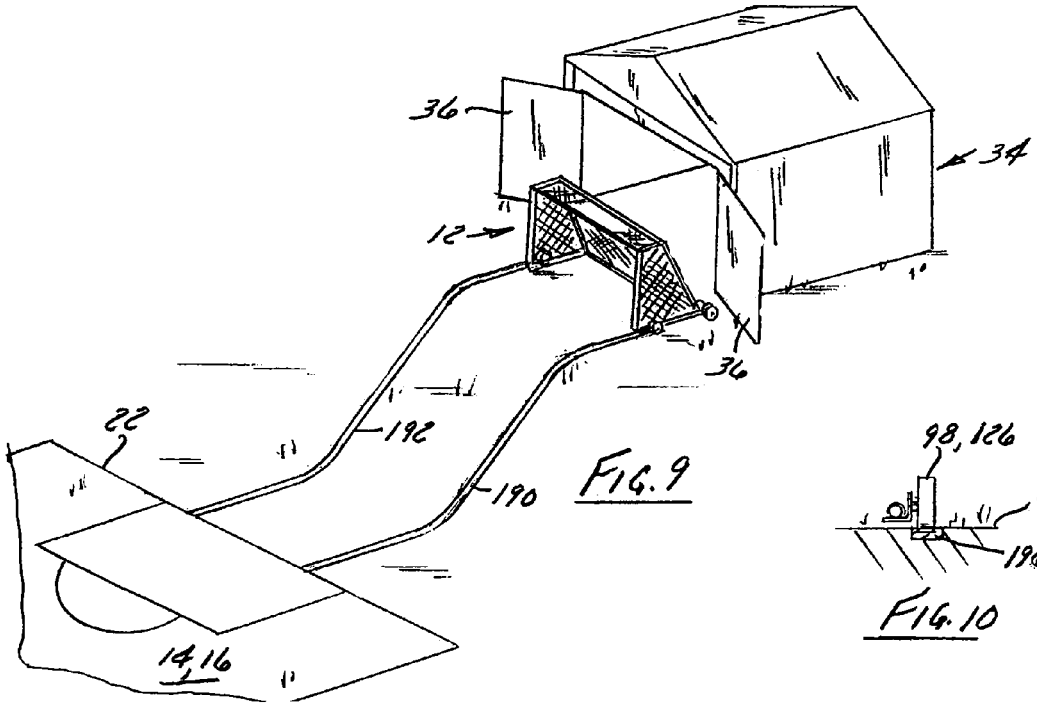
FIG. 9 shows a view similar to FIG. 1 with one goal assembly in transit between an in-use position and a non-use or stored position.
Figure 10:
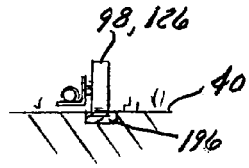
FIG. 10 is an elevational side view of one of the goal assemblies shown in FIG. 1 and shows an orientation indictor for simplifying positioning of a respective goal assembly relative to a play surface.

FIGS. 9-10 show a preferred embodiment of the invention. Referring to FIG. 9, control system 162 preferably includes a receiver 170 that wirelessly communicates with a remote control 174. Preferably, remote control 174 includes a number of inputs that include a first joystick or input 176 and a second joystick or input 178 that are configured to allow concurrent operation of one or more drive mechanisms 86, 88 and/or goal assemblies 12. It is appreciated that remote control 174 could be provided in virtually any form factor and be provided with any of a number of input configurations including buttons, joysticks, switches, a touch pad, dials, buttons, voice controls, or other types of user input devices. Regardless of the modality of the input, the input signals control speed and direction of the respective goal assembly 12 relative to surface 40.

Remote control 174 includes an antenna 180 configured to enable wireless communication with a corresponding antenna 182 associated with a receiver 170 of desired drive mechanism 124 of a target goal frame assembly or simply frame 46. Signals communicated to drive mechanism 124 via remote user interaction with one or more of joysticks 176, 178, allows remote operation of wheel 126 and thereby remote manipulation of goal assembly while relative to surface 40. Any known type of encryption, modulation, or other type of signal marking may be used to facilitate communication between the remote controller 174 and the one or more goal assemblies 12.

It is further appreciated that a radio-based communication system is but one type of system that may be used to facilitate the transmission of movement signals to the respective goal assemblies 12. For example, line-of-sight technologies may be used. Global positioning communication systems may also be used. Global positioning and similar systems may also be used to automate placement and/or movement of the respective goal assemblies 12. For instance, the user may identify the GPS coordinates (either directly or indirectly) of a desired position for a respective goal 12 or a discrete portion thereof, and upon receipt of a suitable command from the user, such as by remote controller 174 or other electronic device such as a PDA, laptop, cell phone, tablet, the respective goal 12 can be moved automatically to the respective GPS coordinates. Understandable, it is also envisioned that such a communication protocol can also be used to effectuate in-use, non-use, stored, or intermediate positioning of a respective goal assembly 12 relative to surface 40.

As alluded to above, it is also contemplated that mobile technology may also be used to communicate movement commands to the respective goal assemblies. For example, in one embodiment, receiver 170 may be formed as a bi-directional mobile communication device mounted relative to frame 46 and in a manner so as to communicate with controller 174 or another remote electronic device. Command signals may then be provided to the mobile communication device using conventional mobile communication systems, such as a cellular or mobile phone, personal data assistant (PDA), touchpad, personal computer, tablet, and the like.

Regardless of the specific configuration of the communication protocol, it is further appreciated that remote control 174 can be configured to communicate with more than one goal assembly. Such interaction can include frequency isolation and/or simply be integrated by requiring a confirmation protocol or sequence associated with proper association of a particular goal or frame assembly with the intentions or desires of the operator.

Single user interaction with remote control 174 allows a single unassisted user to translate multiple goal assemblies 12 relative to field 14, 16 and/or the end line 22 associated therewith. Preferably, after movement of a respective goal assembly 12, only the nonpermanent indications 190, 192 associated with translation of goal assembly 12 relative to end line 22 evidence the recent translation of goal assembly 12 relative to surface 40. Manipulation of doors 36 of storage 34 allows a single person or user to effectuate sequential or concurrent translation of one or multiple goal assemblies 12 from the in-use positions associated with surface 40 to a stored or non-use positions and/or orientations of goal assemblies 12 relative thereto.

As shown in FIG. 10, it is further envisioned that surface 40 include one or more indicators 196 associated with the repeatable orientation of one or more of wheels 98, 126 of respective goal assemblies 12 relative to fields 14, 16 to further improve the expediency with which a single user can orient multiple goal assemblies 12 relative to fields 14, 16 and/or surface 40. It is further envisioned that indicator 196 may be permanent or temporary and/or mechanical or electrical in nature. That is, it is envisioned that the global positioning (GPS) of one end post may be assigned such that the goal frame assembly 12 can be expediently returned to the designated in-use or non-use location and/or orientation.

Figure 11:
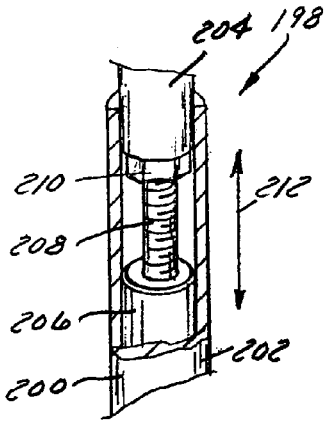
FIG. 11 is a partial cross-sectional view of a goal spatial adjustment feature of one or more of the goal assemblies shown in FIG. 1.
Figure 12:
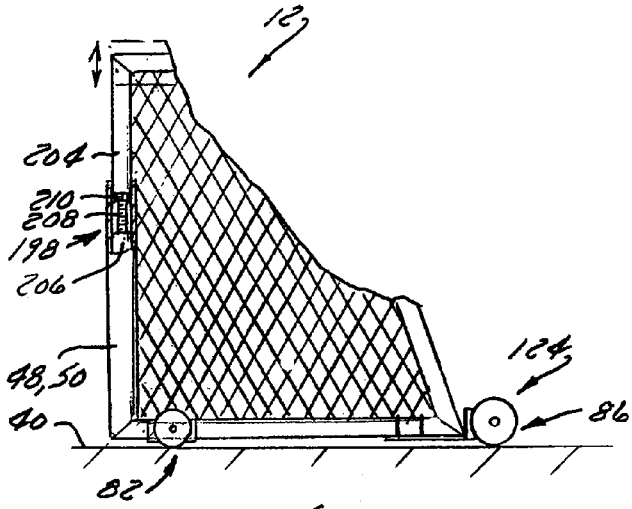
FIG. 12 is a side elevation view of a goal assembly equipped of one or more of the spatial adjustment features shown in FIG. 11.

FIGS. 11 and 12 show an additional aspect of the present invention. As shown in FIG. 11, in a preferred embodiment of the invention, an adjustment mechanism 198 is provided in one or more of the elongate members 200 of frame 46 of goal assembly 12. Adjustment mechanism 198 includes a first tube 202 that telescopically cooperates with a second tube 204. The drive member 206 is disposed within first tube 202 and includes a screw 208 that is driven by drive member 206. Second tube 204 includes a follower 210 that operationally cooperates with screw 208 such that rotation of the screw 208 manipulates a longitudinal length, indicated by arrow 212, of elongate member 200.

As shown in FIG. 12, in one embodiment, goal posts 48, 50 of goal assembly are each provided with an adjustment mechanism 198 whose operation manipulates the length of the respective longitudinal member to alter the size associated with goalmouth 58. Such a construction allows a single goal assembly 12 to satisfy the spatial requirements commonly associated with different sized goal assemblies. It is further appreciated that the longitudinal length of one or more of the elongated members can be manipulated so that a common goal assembly can be used for play by players of different age classifications as well as for unique training drills wherein a goal sized differently than a game goal size may be desired for particular drills and/or training. It is further appreciated that the other longitudinal members may be pivotably connected to one another and/or otherwise deviate from a rigid construction and/or connection so as to tolerate the adjustability of one or more of the longitudinal members. It is further appreciated that the horizontal members could be provided with a similar construction so as to allow adjustment of the longitudinal length of goalmouth 58. It is further appreciated that the operation and control of drive member 206 could be independently powered and/or powered by power source 160 associated with a respective drive system 86, 88 and independently controlled with a supplemental remote control and/or integrated with the operation of remote control 174. Such a power and control hierarchy would limit system redundancies and provide a goal system whose position, orientation, and respective size can be manipulated from a single or unitary, and preferably remote, control interface. Such a construction would also reduce the spatial requirements associated with storage 34 for providing covered storage of multiple goal assemblies wherein each respective goal structure could attain a smallest capable shape prior to being placed in storage.

Therefore, one embodiment of the invention, that is usable or combinable with one or more features of the above embodiments, includes a sport goal assembly having a frame that is shaped to define a goalmouth and support a goal net for interaction with one or more players on a playing field. At least one frame propulsion device is engaged with the frame and operative to translate the frame along a surface. At least one motor selectively drives the at least one frame propulsion device to effectuate translation of the goal frame relative to the play surface.

Another embodiment of the invention that is usable or combinable with one or more of the above embodiments includes a goal transport system having a frame that is removably engageable with a field sport goal. The system includes a drive member that is supported by the frame and a motor that is connected to the drive member and the frame such that operation of the motor effectuates movement of the drive member relative to a ground surface and movement of the field sport goal when the field sport goal is engaged with the frame.

Another embodiment of the invention that is usable or combinable with the above embodiments includes a method of providing a sport goal movement system. A drive system is connected to a power supply and engaged with a goal structure so that operation of the drive system effectuates unassisted or non-manual labor translation of the goal structure relative to a play surface.

The present invention has been described above in terms of the preferred embodiments. It is recognized that various alternatives and modifications may be made to these embodiments which are within the scope of the appending claims.

What is claimed is:

1. A sport goal assembly comprising;

a frame that includes a plurality of elongated members that are connected to one another to define a soccer goal and arranged to define a goalmouth wherein a size of the goalmouth is associated with an age range of one or more players and the frame supports a goal net for interaction with the one or more players on a playing field;

at least two of the elongated members defined by a first tube and a second tube that telescopically cooperate with one another;

an adjustment mechanism disposed between the first tube and the second tube of each of the at least two elongated members, each adjustment mechanism including a driven member supported by the first tube and a follower supported by the second tube, the driven member and the follower cooperating with one another such that operation of a drive member effectuates translation of the follower along the driven member in an axial direction along the longitudinal axis associated with the respective first and second tubes to manipulate a length of the respective elongated member;

a first frame propulsion device and a second frame propulsion device each separately engaged with the frame such that the first and second frame propulsion devices are disposed on opposite lateral sides of the goalmouth of the frame and operative to translate the frame along a surface to position the frame and rotationally orient the frame such that the goal mouth faces a playing field; and at least one motor associated with each of the first and second frame propulsion devices for selectively driving the respective first and second frame propulsion devices.

2. The sport goal assembly of claim 1 further comprising a sub-frame connected to each of the first and second frame propulsion devices and the at least one motor and removably securable to a respective frame that defines a goalmouth.

3. The sport goal assembly of claim 1 wherein the frame propulsion device is further defined as one of a wheel or a track.

4. The sport goal assembly of claim 1 further comprising a receiver adapted to receive remotely transmitted drive signals and a controller that provides command signals to each of the first and second frame propulsion devices based on the remotely transmitted drive signals.

5. The sport goal assembly of claim 4 wherein, the command signals initiate operation of each of the first and second frame propulsion devices to effectuate movement of the frame between an in-use position and at least one of a temporary location and a stored position.

6. A goal transport system comprising:

a soccer sport goal defined by a plurality of elongated members wherein a plurality of the elongated members are defined by a plurality of sections that telescopically cooperate with one another;

a first frame that is removably engageable with the soccer sport goal;

a second frame separate from the first frame and that is removably engageable with the soccer sport goal at a location remote from the first frame and offset from the first frame by an elongated member of the soccer sport goal;

a first drive member supported by the first frame and a second drive member supported by the second frames;

a first motor connected to the first drive member associated with the first frame and a second motor connected to the second drive member associated with the second frame, the first motor connected to the first drive member and the second motor connected to the second drive member such that operation of the respective first motor and second motor effectuates movement of the respective drive member relative to a ground surface and movement of the soccer sport goal to achieve a desired position and a desired rotational orientation of a goalmouth of the soccer sport goal when the soccer sport goal is engaged with each of the first frame and the second frame; and a screw associated with one of the plurality of sections and a follower associated with another of the plurality of sections of at least two of the plurality of elongated members; and a length adjustment motor engaged with each screw such that operation of the respective length adjustment motor causes rotation of the screw and translation of the follower along the screw such that a longitudinal length of each of the at least two of the plurality of elongated members can be remotely adjusted.

7. The goal transport system of claim 6 further comprising a communication system including a control and a receiver configured to communicate operating instructions to each of the respective first, second, and length adjustment motors.

8. The goal transport system of claim 7 wherein the control and the receiver wirelessly communicate with one another.

9. The goal transport system of claim 7 wherein the operation instructions include destination information.

10. The goal transport system of claim 9 wherein the destination information includes position and orientation information.

11. The goal transport system of claim 6 further comprising a power source supported by the frame and operationally connected to each motor.

12. A method of providing a sport goal system comprising:

connecting each of a drive system and an adjustment mechanism to a power supply;

engaging the drive system and the adjustment mechanism with a soccer goal structure that is defined by a plurality of adjustable length elongated members so that operation of the drive system effectuates unassisted translation of the goal structure relative to a play surface and operation of the adjustment mechanism concurrently adjusts a longitudinal length of at least two of the plurality of adjustable length elongated members; and providing a control system configured to control operation of the drive system to cause the unassisted translation of the goal structure relative to the play surface and control operation of the adjustment mechanism to adjust a size of the goal structure via operation of the adjustment mechanism, the control system further comprising defining at least one preset associated with defining a radial orientation of a goal mouth and a position of the goal structure relative to at least one of the play surface or a storage location.

13. The method of claim 12 further comprising connecting the drive system and power supply with a frame that removably cooperates with the goal structure.

14. The method of claim 12 wherein the drive system includes one of a wheel or a track that extends between the goal structure and the play surface when the drive system is engaged with the goal structure.

* * * * *